US005467804A

United States Patent [19]

Kupferschmidt et al.

[11] Patent Number: 5,467,804

[45] Date of Patent: Nov. 21, 1995

[54] WIRE TWISTER-CUTTER ASSEMBLY

[75] Inventors: Albert Kupferschmidt, Highland Park; John Wiedel, Chicago, both of Ill.

[73] Assignee: L&P Property Management Company, Chicago, Ill.

[21] Appl. No.: 188,462

[22] Filed: Jan. 26, 1994

[51] Int. Cl.[6] ..... B21F 15/04

[52] U.S. Cl. ..... 140/115; 140/93.6

[58] Field of Search ..... 140/93.6, 115, 140/119

[56] References Cited

U.S. PATENT DOCUMENTS 1,460,649 7/1923 Gerrard ..... 140/93.6

1,821,389 9/1931 McChesney ..... 140/93.6

1,937,767 12/1933 Lennox ..... 140/93.6

OTHER PUBLICATIONS

U.S. Wire–Tie Systems–Operating & Maintenance Instructions and Repair Parts List–Model 1302 Portable Pneumatic Wire–Tieing Machine.

*Primary Examiner*—Lowell A. Larson

*Attorney, Agent, or Firm*—Wood, Herron & Evans

[57] ABSTRACT

There is disclosed an assembly mountable as a unit in a wire-tieing machine, including a bearing block in which a twister pinion is rotatably disposed. Wire restraining yoke members and cooperating cutter members are mounted to opposite ends of the bearing block.

12 Claims, 2 Drawing Sheets

WIRE TWISTER-CUTTER ASSEMBLY

BACKGROUND OF THE INVENTION

The present invention relates to an apparatus for wire-tieing and, more particularly, to a novel wire-twisting subassembly used in a wire-tieing machine.

Pneumatic, hydraulic, or electric wire-tieing machines having means for gripping and twisting two wires, or opposite ends of the same wire, together are well-known. One such machine, sold by U.S. Wire Tie Systems, a unit of the assignee of the present invention, is known as the Model-1302 Portable Pneumatic Wire-Tieing Machine. This machine utilizes a slotted wire-twister pinion having reduced diameter journal portions extending from opposite ends of a central gear portion. Separate bearing elements are mounted for supporting the gear, and cutters must be separately installed for cutting the wire. Such parts are subject to wear and breakage and must be replaced from time to time. In addition, different sizes of twister gears and cutters may be required for processing wires of different gauge, so that, again, the twister gear and cutters must be changed. Such changes of parts may require considerable down time whereby the efficiency in the overall wire-tieing operation is reduced.

SUMMARY OF THE INVENTION

It is an object of the present invention to provide a novel wire-tieing machine constructed so as to permit wear parts, such as a twister gear and cutters, to be removed and replaced easily and rapidly, whereby to reduce the down time of the machine.

A more specific object of the present invention is to provide a novel wire-twisting machine subassembly, including a twister pinion and cutters which may be easily installed as a unit.

A still further object of the present invention is to provide a novel subassembly of the above-described type, which is of relatively economical and long-lasting construction.

Other objects and advantages of the present invention will become apparent from the following description and the accompanying drawings.

In accordance with the present invention, a slotted bearing block is provided having a uniform diameter bore therethrough for receiving a slotted pinion body. The pinion body has journal portions at opposite ends thereof and a central gear portion having a diameter similar to but slightly less than the diameter of the journal portions. Wire cutters are connected to opposite ends of the bearing block. The bearing block and the parts connected thereto provide a subassembly adapted to be quickly and easily installed as a unit in a wire-tieing machine.

DETAILED DESCRIPTION OF A PREFERRED EMBODIMENT

Figure 1:
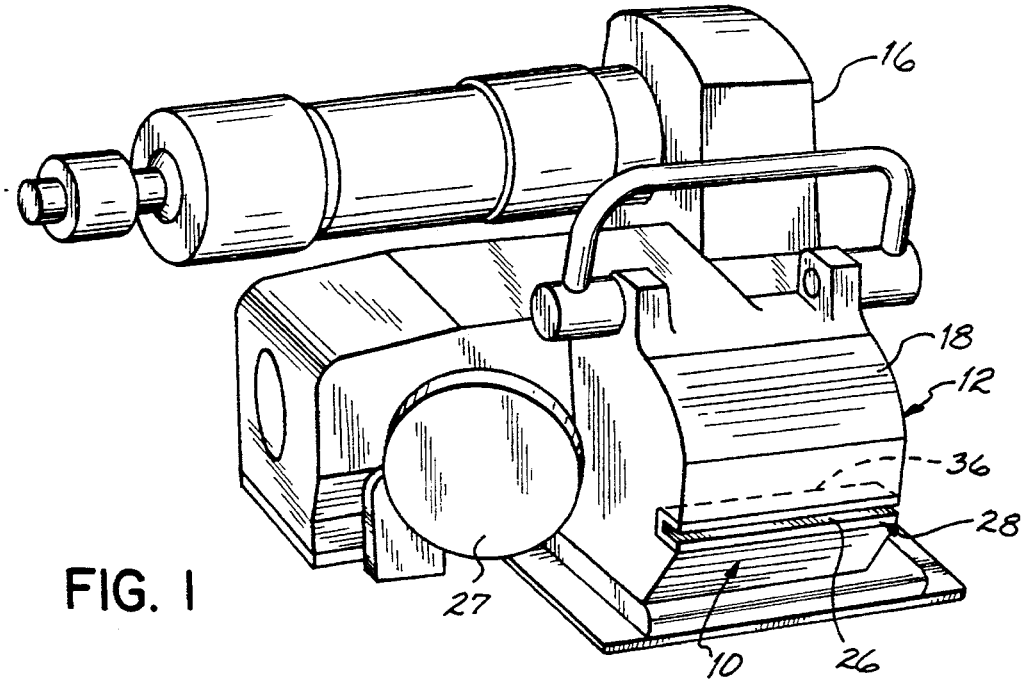
FIG. 1 is a simplified perspective view of a wire-tieing machine in which a subassembly incorporating features of the present invention may be installed.

Referring now to the drawings, wherein like parts are designated by the same numerals throughout the various figures, a wire-twister subassembly or unit 10 incorporating features of the present invention is shown in FIGS. 2 through 6. This subassembly may be used in various wire-tieing machines of known construction, so that such machines need not be described in detail herein. FIG. 1 provides a simplified illustration of one such machine 12, in which the unit 10 is mounted. In general, the machine comprises a pneumatic motor 16 adapted to drive a twister pinion and actuate cutters through mechanisms of known construction mounted within a housing 18. The machine may also be hydraulically or electrically operated without departing from the scope of the invention.

Figure 3:
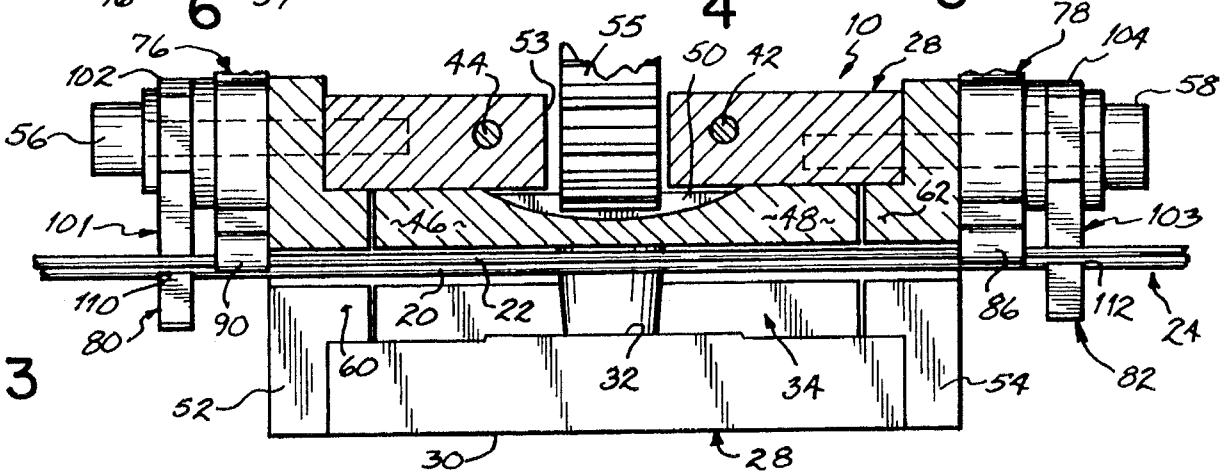
FIG. 3 is a partial sectional view taken along line 3—3 in FIG. 2, and further showing a wire being tied and cut.

The machine 12 may be used for twisting or tieing together end portions 20 and 22 of a wire 24 in a manner shown in FIG. 3. In order to accomplish this, the portions 20 and 22 of the wire are inserted into the twister assembly 10 through a slot 26 in a side thereof. As will be understood, the wires are frequently used to bundle one or more articles and, therefore, it is desirable to place the wire under tension, so that it is drawn tightly around the articles. This is accomplished by gripping one end of the wire by a suitable gripper means, not shown, and acting on the wire with a tensioning wheel 27, indicated generally in FIG. 1.

Figure 4:
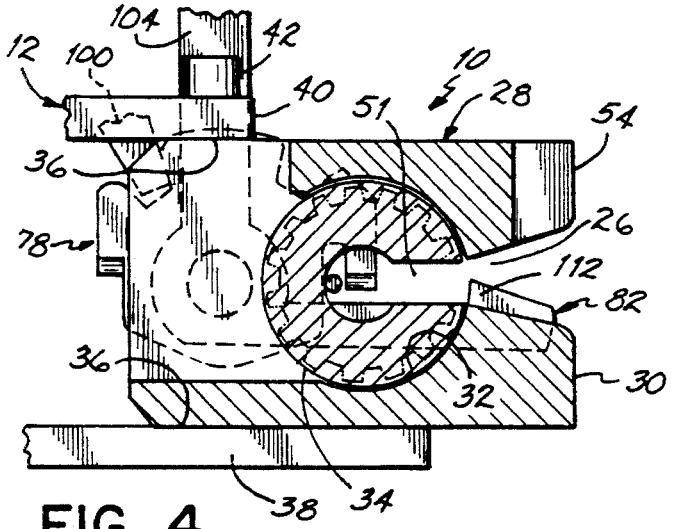
FIG. 4 is a sectional view taken along line 4—4 in FIG. 2.
Figure 2:
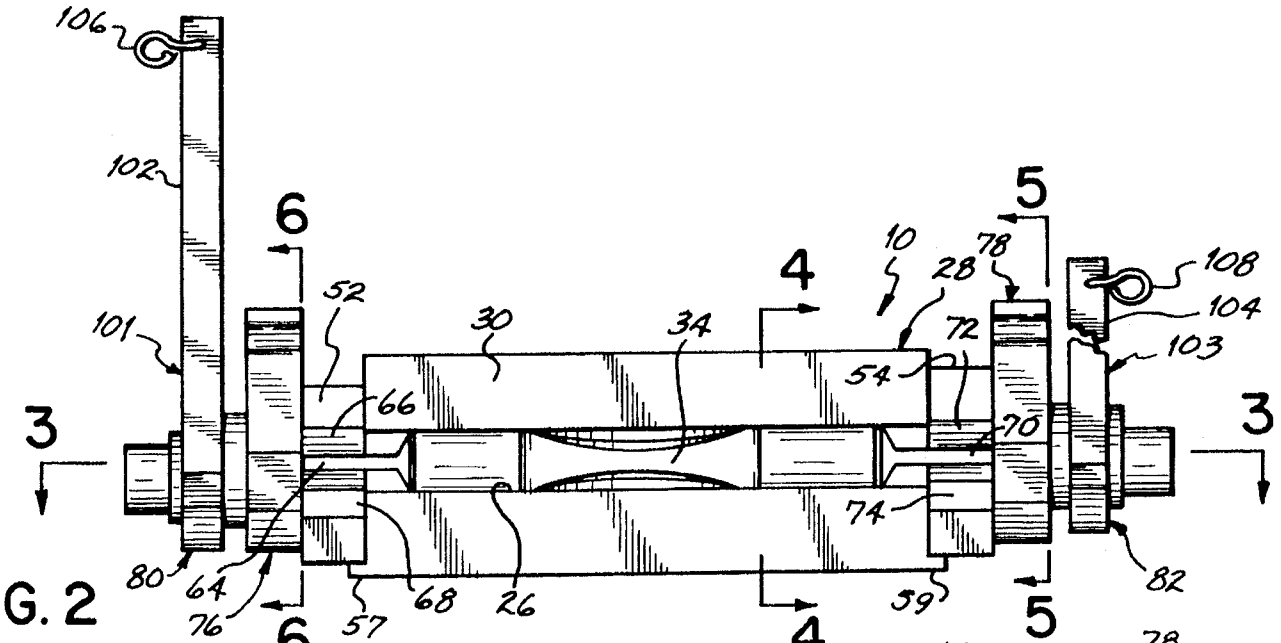
FIG. 2 is an enlarged elevational view showing a subassembly of the present invention, including a wire-twister pinion, a bearing block, and wire cutters.

Referring now more specifically to FIGS. 2, 3, and 4, it is seen that the subassembly or unit 10 comprises a base member or bearing block 28 having the aforementioned slot 26 through a front side 30 thereof. The slot 26 intersects a central longitudinally extending bore 32 of uniform diameter, which provides bearing surfaces for receiving and rotatably supporting a twister pinion 34. As indicated in FIGS. 1 and 4, the bearing block 28 is adapted to be received in an opening 36 provided in the housing 18 of the machine, and is supported between frame members 38 and 40. A plurality of screws 42 and 44 extending through the frame member 40 and into the block 28 enable the block, and thus the remaining components which comprise the subassembly 10, to be quickly and easily assembled with or removed from the machine.

The twister gear 34 incorporates a novel construction which is disclosed and claimed in a related application, Ser. No. 08/187,200, filed concurrently herewith by the present inventor. The disclosure of this related application is incorporated herein by reference. It suffices to state here that the twister pinion 34 comprises an elongated body having opposite end journal portions 46 and 48 with a diameter similar to the diameter of the bore 32, so that the bore 32 provides bearing surfaces rotatably supporting the twister pinion. The pinion also has a central gear portion 50, with gear teeth having a maximum diameter similar to, but slightly less than, the diameter of the journal portions 46 and 48, and merging with the opposite end journal portions as described in the aforementioned co-pending application, so that the teeth are well supported for resisting breakage. A slot 51 is formed in the side of the twister pinion, and is adapted to be aligned with the slot 26 in the side of the bearing block for enabling the wire to be inserted into and removed from the twister pinion. The bearing block 28 has a notch 53 in the back side thereof for exposing the tooth or gear portion 50 of the twister pinion 34. The machine 12 has a mechanism driven by the motor 16 and including a gear 55 meshing with the gear portion 50 for driving the twister pinion 34.

Yoke members 52 and 54 are secured to opposite ends of the bearing block 28 by screws 56 and 58. Abutments or ledges 57 and 59 project from the bearing block and engage beneath the yoke members for holding the yoke members against rotation around the mounting screws. The yoke members respectively include bosses 60 and 62 projecting into the bore 32 in the bearing block or member 28 for engaging opposite ends of the twister pinion 34 and retaining the pinion against axial displacement.

The yoke member 52 has a forwardly opening slot 64 defined by upper and lower fingers 66 and 68. The yoke 54 has a similar forwardly opening slot 70 defined by upper and lower fingers 72 and 74. The slots 64 and 70 are aligned with the slot 26 in the bearing block for permitting insertion of the wire portions between the fingers. The slots 64 and 70 progressively decrease in width from their outer ends toward their inner ends. Preferably, the minimum dimension of the slots 64 and 70 is similar to, but slightly greater than, the gauge or diameter of the wire to be processed so that the fingers will serve to hold the wire positively during the twisting and cutting operations described below.

The screws 56 and 58 serve not only to mount the yoke members 52 and 54 to opposite ends of the bearing block, but also to pivotally connect cutter members 76 and 78 and wire positioning and retaining fingers 80 and 82 to opposite ends of the bearing block. These parts together with the base member or bearing block 28, the twister pinion 34, and the yoke members 52 and 54 make up the subassembly 10, which may be readily installed as a unit in the wire-twisting machine 12.

Figure 5:
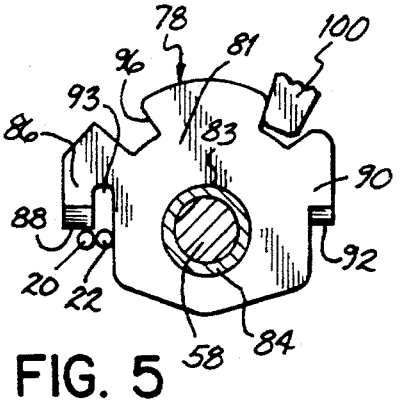
FIG. 5 is a sectional view taken along line 5—5 in FIG. 2, showing a cutter in position to cut one wire portion.

As indicated in FIGS. 3 and 5, the cutter member 78 is constructed and arranged so as to cut an end of the wire portion 20, while the cutter member 76 is adapted to cut an end of the wire portion 22. In order to reduce manufacturing and stocking costs, the cutter members 76 and 78 are preferably of identical construction, as indicated best in FIGS. 5 and 6. More specifically, each of the cutter members includes a main body portion 81 having a central aperture 83 for receiving a bearing element 84 surrounding its respective mounting screw 56, 58. A first cutter element 86, presenting a first wire cutting edge 88, projects from a peripheral marginal portion of the body 81, and a second cutter element 90, presenting a second cutting edge 92, projects from a generally opposite marginal portion of the body 81. As shown in FIG. 5, the cutting edge 88 is radially position with respect to the axis of rotation of the cutter for engaging and cutting the wire portion 20, which, for the sake of convenience, may be identified as the outer wire portion in the twister apparatus. A slot 93 is formed between the cutter edge 88 and the main body 81 of the cutter member, so as to provide clearance for the inner wire portion 22 during a cutting operation.

Figure 6:
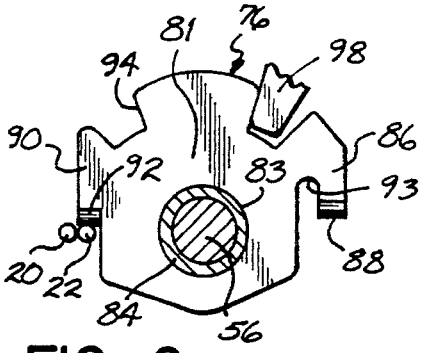
FIG. 6 is a sectional view taken along line 6—6 in FIG. 2, showing a cutter in position to cut another wire portion.

While the cutter members 76 and 78 are identical, it will be seen upon viewing FIGS. 5 and 6 that the member 78 at the opposite end of the bearing block from the member 76 reverses the positions of the cutting edges 88 and 92, so that the cutting edge 92 is presented for acting on the wire. The cutting edge 92 is radially positioned with respect to the axis of rotation of the cutter member a distance less than the cutting edge 88, so that the cutting edge 92 is adapted to cut the inner wire portion 22, rather than the outer wire portion.

The cutter members 76 and 78 are respectively provided with peripheral notches or teeth 94 and 96. These teeth are adapted selectively to be engaged by actuating pawls or teeth 98 and 100, forming a part of the cutter actuating mechanism within the machine 12.

The wire positioning and retaining fingers 80 and 82 are, in the embodiment shown, a part of bell cranks 101 and 103 respectively mounted on the screws 56 and 58, and including lever arms 102 and 104. Springs 106 and 108, or other suitable means, are provided for normally holding the bell cranks 101 and 103 so that the upper surfaces of fingers 80 and 82 are approximately level with the upper surfaces of the lower yoke member portions 68 and 74, respectively. Furthermore, each of the fingers 80 and 82 includes a hook surface 110 and 112, with the hook surface of finger element 82 being shown best in FIG. 4. The arrangement is such that when the wire portions are initially inserted into the slots in the bearing block, the twister pinion, and the yoke members, the hook elements or surfaces 110 and 112 will prevent the wire from slipping out prior to operation of the twister pinion. However, when the twisting or tieing operation has been completed, the finger elements 80 and 82 may be readily depressed, either manually or by a suitable mechanism, not shown, sufficiently to provide clearance for the removal of the wire from the tieing unit.

When conducting a wire-tieing operation, the machine is first adjusted so that the slot in the twister pinion 34 is in alignment with the slots in the bearing block 28 and the yoke members 52 and 54. Then, the wire is inserted into the aligned slots where it is retained by the hook elements 110 and 112 of the retaining fingers 80 and 82, while the wire is place under tension by the tensioning means in the machine 12. Thereafter, the machine is operated for rotating the pinion preferably through a plurality of rotations, usually three, so that the abutting portions of the wire are tied together. The apparatus is then operated for rotating the cutter members 76 and 78 to cut the ends from the wire portions 20 and 22.

While a preferred embodiment of the present invention has been shown and described herein, many structural details may be changed without departing from the spirit and scope of the appended claims.

The invention is claimed as follows:

1. An assembly for use in a wire-tieing machine comprising:

a base member having a bearing bore therethrough and a wire receiving side slot intersecting said bore, a wire-twister pinion rotatably disposed in said bore and having a wire receiving side slot therein for receiving first and second wire portions in side-by-side relationship for twisting about each other upon rotation of said pinion, members respectively mounted on opposite ends of said base member by mounting screws extending into said base member for resisting twisting of the wires around each other at said opposite ends of said base member, and first and second cutter members shiftably mounted on said opposite ends of said base member outwardly of said members for respectively cutting said first and second wire portions, said assembly being mountable as a unit in, and removable as a unit from, said wire-tieing machine.

2. An assembly, as defined in claim 1, which includes shiftable wire support and retaining elements respectively mounted on said opposite ends of said base member outwardly of said cutter members for retaining the wire portions prior to a twisting operation.

3. An assembly, as defined in claim 2, wherein said cutter members and said shiftable support elements are pivotally mounted by said mounting screws for movement about a common axis.

4. An assembly, as defined in claim 1, wherein said members at opposite ends of said base member for resisting twisting of the wire portions respectively include a yoke having finger portions for embracing the wire portions and cooperating with the cutter members for severing the wire.

5. An assembly mountable as a unit in a wire-tieing machine comprising:

a one-piece bearing block having a bearing bore of uniform diameter therein, a twister pinion including a journal portion and a tooth gear portion rotatably mounted in said bore, said pinion and said bearing block having side slots therein for receiving adjacent first and second portions of wire to be twisted, yoke members respectively secured to opposite ends of said bearing block by mounting screws extending into said bearing block for receiving and restraining said wire portions, and cutter members respectively mounted against said yoke members, one of said cutter members having a first cutting edge disposed for cutting said first wire portion, and the other of said cutter members having a second cutting edge disposed for cutting said second wire portion.

6. An assembly, as defined in claim 5, wherein said cutter members are pivotally mounted for movement about a common axis, said cutter members being substantially identical, said first cutting edge being disposed radially from said axis a first radial distance, and said second cutting edge being disposed from said axis a second radial distance different from said first distance.

7. An assembly, as defined in claim 6, wherein said cutter members are pivotally mounted by said mounting screws.

8. An assembly, as defined in claim 5, which includes first and second bell cranks respectively pivotally connected to said opposite ends of said bearing block, each of said bell cranks including a hook portion for retaining said wire portions in said slots prior to a twisting operation.

9. An assembly, as defined in claim 8, wherein said first and second bell cranks are pivotally mounted by said mounting screws for movement about a common axis.

10. An assembly, as defined in claim 5, which includes means resiliently biasing said bell cranks to a wire-retaining position, said bell cranks being shiftable from said position for releasing the wire portions upon completion of a twisting operation.

11. An assembly, as defined in claim 5, wherein said cutter members include notch means engageable by an element for actuating the cutter members.

12. An assembly, as defined in claim 5, wherein said bearing block comprises notch means generally oppositely from said bearing block slot for exposing said gear portion for engagement with a mating actuating gear.

* * * * *